US005975361A

United States Patent [19]

Corrow

[11] Patent Number: 5,975,361

[45] Date of Patent: Nov. 2, 1999

[54] WINDING AND LOCKING DEVICE FOR COLLAPSIBLE TUBES

[76] Inventor: Richard N. Corrow, c/o Hampton Gallery, 236 Delgado St., Santa Fe, N.Mex. 87501

[21] Appl. No.: 09/121,525

[22] Filed: Jul. 23, 1998

[51] Int. Cl.[6] ..... B65D 35/32

[52] U.S. Cl. ..... 222/99

[58] Field of Search ..... 222/99

[56] References Cited

FOREIGN PATENT DOCUMENTS

| | | | |
|---|---|---|---|
| 47447 | 3/1982 | European Pat. Off. | 222/99 |
| 2153329 | 8/1985 | United Kingdom | 222/99 |
| 2174355 | 11/1986 | United Kingdom | 222/99 |

*Primary Examiner*—Philippe Dergkshani
*Attorney, Agent, or Firm*—Richard R. Mybeck; Peter B. Scull

[57] ABSTRACT

A device for winding and locking collapsible tubes or like containers. This device involves a key-like assembly having at least one handle portion and a spindle about which the tube/container is to be wound. The handle portion also includes at least one flange or stop member that is itself flexible or is flexibly connected to the handle portion. The stop member provides for locking the wound portion of the tube/container on the spindle by resilient contact with the tube/container after being flexibly moved from one side to the other of the tube/container.

19 Claims, 4 Drawing Sheets

FIG. 1
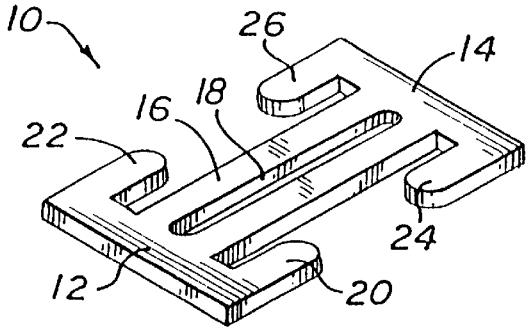
FIG. 2
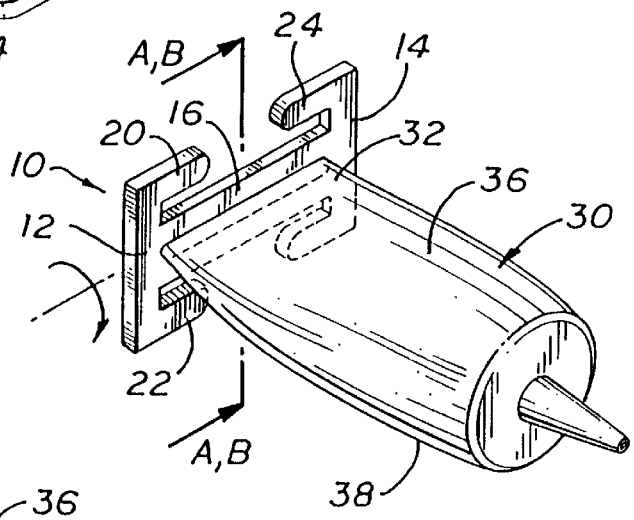
FIG. 3
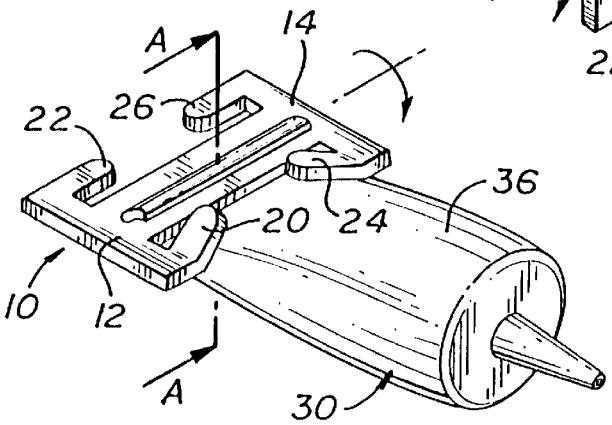
FIG. 2B
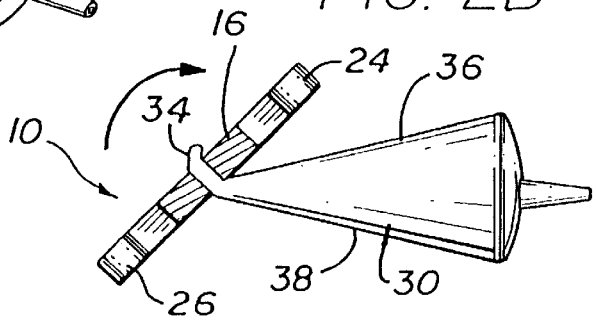
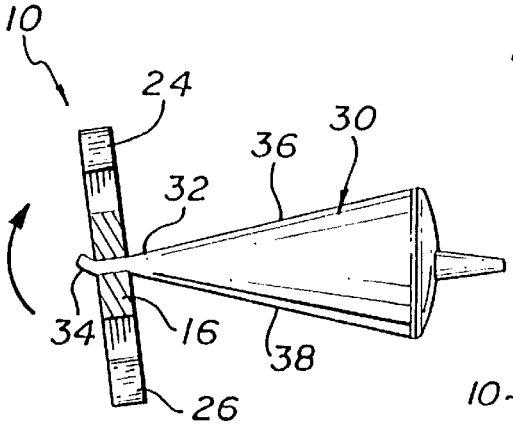
FIG. 2A
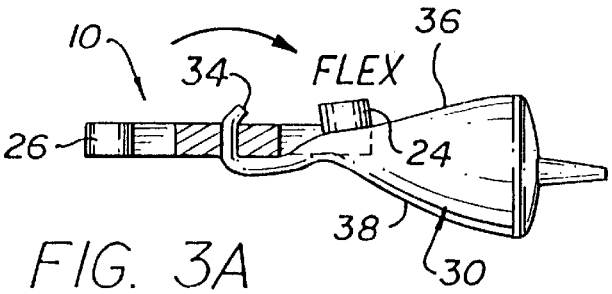
FIG. 3A

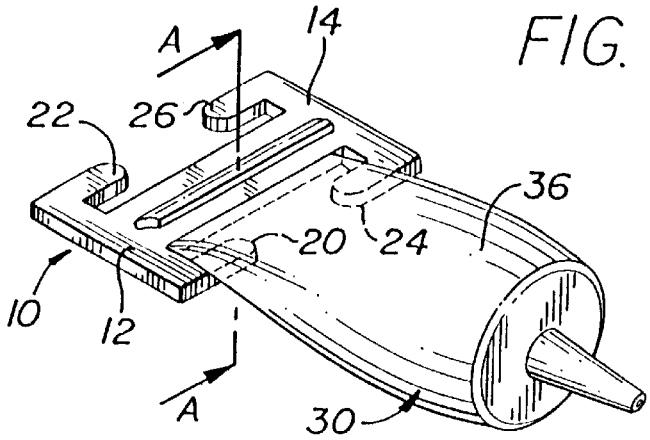
FIG. 4
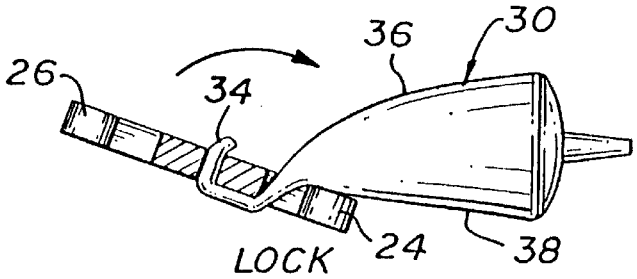
FIG. 4A
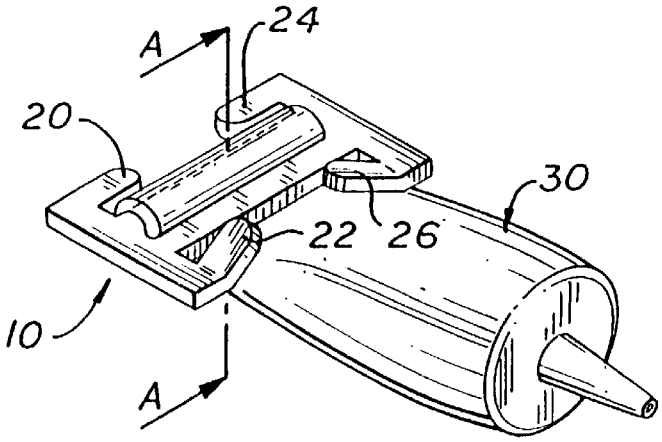
FIG. 5
FIG. 5A
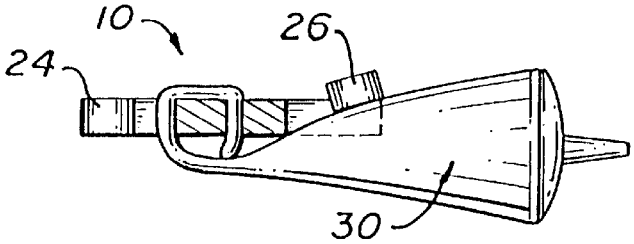

FIG. 6
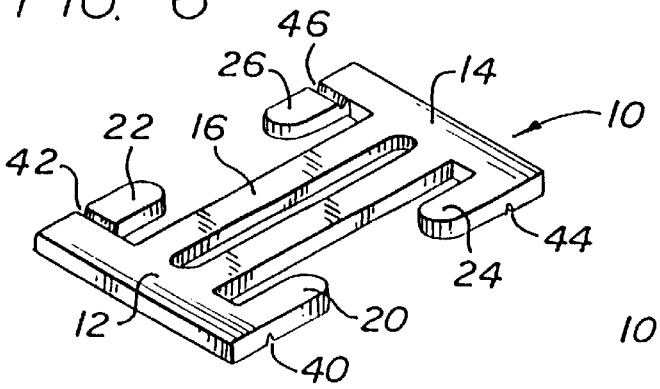
FIG. 7
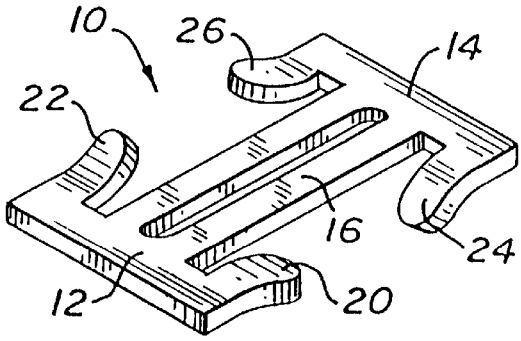
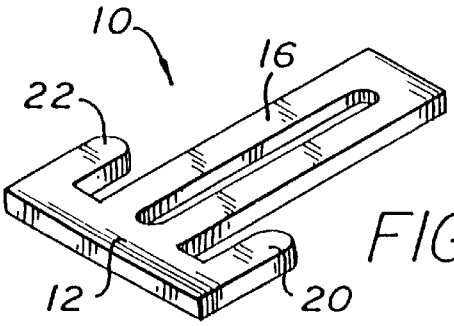
FIG. 8
FIG. 9
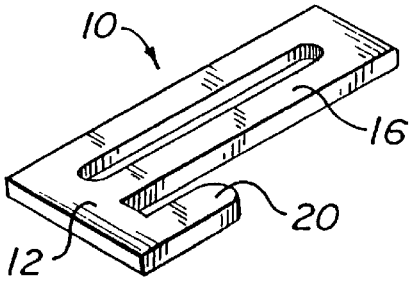
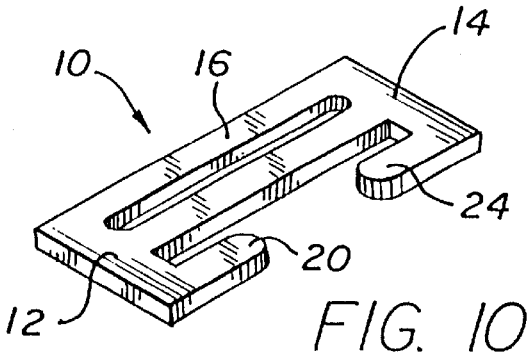
FIG. 10

WINDING AND LOCKING DEVICE FOR COLLAPSIBLE TUBES

INTRODUCTION

The present invention relates generally to devices for facilitating the extrusion of toothpaste-like materials from collapsible tubes and like containers. More particularly, the present invention comprises a winding and locking device for the simultaneous winding of the collapsible tube or like container and thereafter locking the used, wound portion of the tube/container to prevent regression of the remaining contents back into the used, wound portion of the tube/container.

BACKGROUND OF THE INVENTION

The prior art includes several devices for winding and/or locking tubular containers in order to assist in the dispensing of the materials contained therein. See e.g., Campbell, U.S. Pat. No. 2,570,204; Meyer, U.S. Pat. No. 3,291,344; Kahlow, U.S. Pat. No. 3,303,969; Namdari et al., U.S. Pat. No. 4,421,251; Elias et al., U.S. Pat. No. 4,576,314; Pearson, U.S. Pat. No. 4,998,645; Curtis, U.S. Pat. No. 5,058,771; Yanagisawa, U.S. Pat. No. 5,102,014; and Lee, U.S. Pat. No. 5,642,839.

As can be seen from the art, it has long been recognized that a distinct desideratum has existed for simplifying the extrusion of contents from a collapsible tube or like container (hereafter, "tube/container") by squeezing and winding-up the tube/container. Several devices, albeit complex, have been disclosed (see the above-cited references, for example) which provide for the squeezing and/or winding of a tube/container associated therewith. Moreover, the art also teaches that it is desirable to somehow maintain the wound portion of the tube/container in its wound-up disposition to prevent the migration or regression of the material contents backwards within the tube into the evacuated once-wound portion of the tube. This thereby alleviates the frustration of having to re-squeeze, re-wind and thereby re-empty the once-wound portion over and over again to fully dispense the contents from the tube/container. It also avoids when appropriate, the introduction of atmospheric elements into the tube with consequent possibly deleterious reactions with the principal contents. Hence, when a tube portion is squeezed and wound tight upon a spindle, the contents of that portion having been discharged therefrom, it is then advantageous to be able to lock the tube/container in this wound-up disposition and prevent content regression. It is primarily toward this desideratum that the present invention is directed.

BRIEF SUMMARY OF THE INVENTION

The present invention generally involves devices for winding and locking tubes or like containers to ease extrusion and prevent content regression. More particularly, the present invention involves a key-like assembly having at least one handle portion and a spindle portion about which the tube/container is to be wound. The handle portion also includes at least one flange or stop portion that is itself flexible or is flexibly connected to the handle portion. The stop portion provides for locking the wound portion of the tube/container on the spindle portion by being rotated into contact with one side of the tube/container, flexing to move past the tube/container and then resiliently snapping back into a locking relationship with the opposing side of the tube/container. The invention hereof further fulfills its purposes with mass-producible, low cost, easily installed and if desired, disposable devices which can be readily operated even by users of minimum mechanical skills to obtain optimum results.

Accordingly, the primary object of the present invention is to provide a simplified device for winding a tube/container and locking it in wound position.

Another object of the present invention is to provide a winding and locking device for a tube/container which can be mass produced and made readily available for use with any product which is packaged in a tube/container.

These and still further objects as shall hereinafter appear are fulfilled by the present invention in a remarkably unexpected fashion as will be readily discerned from a careful consideration of the following detailed description of preferred embodiments thereof especially when read in conjunction with the accompanying drawings which form an integral part thereof.

BRIEF DESCRIPTION OF THE DRAWINGS

In the drawings

FIG. 1 is an isometric view of a winding and locking device embodying the present invention;

FIG. 2 is an isometric view of a winding and locking device of the present invention shown with a tube/container which is to be wound thereon;

FIG. 2A is a cross-sectional view of the device of FIG. 2 taken on line A—A thereof;

FIG. 2B is a cross-sectional view of the device of FIG. 2 taken on line B—B thereof in which the device is shown to have been rotated slightly;

FIG. 3 is an isometric view of a winding and locking device of the present invention shown in association with a tube/container being partially wound thereon;

FIG. 3A is a cross-sectional view of the device of FIG. 3 taken on line A—A thereof;

FIG. 4 is an isometric view of a winding and locking device embodying the present invention shown in conjunction with a tube/container being partially wound thereon;

FIG. 4A is a cross-sectional view of the device of FIG. 4 taken on line A—A thereof;

FIG. 5 is an isometric view of a winding and locking device embodying the present invention shown with a tube/container being wound thereon;

FIG. 5A is a cross-sectional view of the device of FIG. 5 taken on line A—A thereof;

FIG. 6 is an isometric view of an alternative embodiment of the present invention;

FIG. 7 is an isometric view of another alternative embodiment of the present invention;

FIG. 8 is an isometric view of another alternative embodiment of the present invention;

FIG. 9 is an isometric view of another alternative embodiment of the present invention;

FIG. 10 is an isometric view of another alternative embodiment of the present invention;

DETAILED DESCRIPTION OF THE INVENTION

Figure 11:
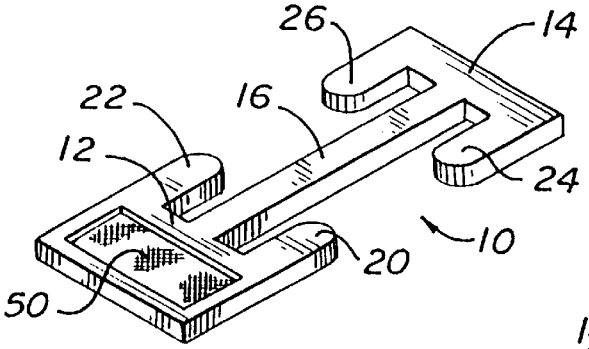
FIG. 11 is an isometric view of another alternative embodiment of the present invention.

The winding and locking device of the present invention is shown in the attached drawings and identified generally by the reference numeral 10. Device 10 is, as shown in FIG. 1, generally a capital letter "I"-shaped device comprising first and second handle portions 12 and 14, each disposed at respective opposing ends of a spindle portion 16. Spindle portion 16 preferably has a slot 18 formed therein for a purpose to be described in further detail below.

Device 10 also preferably has one or more projecting stop members as identified in FIG. 1 by reference numerals 20, 22, 24 and 26. Thus, as shown, stop members 20 and 22 are disposed one each on opposing extended ends of handle portion 12, and stop members 24, 26 are disposed one each on opposing extended ends of handle portion 14.

Stop members 20, 22, 24 and 26 are flexible members or are flexibly connected to respective handle portions 12, 14 for a purpose to be described further below. Stop members 20, 22, 24 and 26 are shown as rounded members projecting inwardly, relatively parallel to but spaced a preselected distance from spindle portion 16.

Preferably, device 10 is formed as a unitary structure as shown, made from any of a plurality of resilient materials which are known to those in the art. Preferably, these materials are to be chosen from known plastics or metals having the preferred characteristics of resilience as described herein. Metallic materials which may not be substantially resilient, may nevertheless be used herewith if integral or attached spring-types of stop members are incorporated therewith. Flat or torsion springs are foreseeable alternatives, here. Preferably, device 10 is molded in one unitary piece, of a material which is sturdy yet provides for flexible movement of stop members 20, 22, 24 and 26 as will be described. An unshown alternative embodiment is foreseeable in which a unitary device 10 is manufactured integrally with a tube/container 30 with which device 10 is to be used.

In use, a collapsible tube, tubular container or the like (hereafter referred to as a "tube/container 30") such as those used for toothpaste, caulking compound, and like products is manipulated in conjunction with device 10 as shown in FIGS. 2–5. Specifically, the rear end portion 32 of tube/container 30 is inserted in slot 18 of spindle portion 16 such that tube/container 30 is disposed in device 10 as shown in FIG. 2. Also, as shown in more detail in FIG. 2A, this initial disposition of tube/container 30 within slot 18 is preferably such that the extreme end 34 of tube/container 30 is extended completely through slot 18 emerging through the backside of spindle 16.

Then, by the application of an external force (such as by hand on handle 12 and/or on handle 14), device 10 may be rotated from the initial position shown in FIGS. 2 and 2A to and through the position shown in FIG. 2B as indicated by the clockwise rotation arrows in FIGS. 2, 2A and 2B. Further rotation in this direction of device 10 relative to tube/container 30 will then take device 10 to the position shown in FIGS. 3 and 3A in which the flexible movement of stop members 20 and 24 is shown. In FIGS. 3 and 3A, stop members 20 and 24 are shown to have been moved first into contact with tube/container 30 and then further to the point where stop members 20,24 have been flexed upwardly to allow for still further rotation of device 10 relative to tube/container 30. Such further rotation then takes device 10 to the position shown in FIGS. 4 and 4A in which stop members 20, 24 have been flexed sufficiently to allow for movement of stop members 20, 24 through, from the upper side 36, to the lower side 38 of tube/container 30. And, as shown in FIGS. 4 and 4A, stop members 20 and 24 have resiliently rebounded to their original orientation relative to the other portions of device 10. In this position, device 10 is locked against tube/container 30 by contact of stop members 20, 24 against the under side 38 of tube/container 30 so that tube/container 30 can not unwind by itself.

More particularly, it is preferred that the strength of device 10 against deformation or bending is such that stop members 20, 24 will not bend in response to pressure caused by the inherent resiliency of tube/container 30 as tube/container 30 would attempt to unwind. Rather, stop members 20,24 prevent any and all unwinding which might otherwise result from the inherent predisposition of tube/container 30 to return to its original flattened shape. Thus, to achieve the desired flexing deformation, an external force which is greater than the inherent resiliency force of tube/container 30 must be applied to rotate handle(s) 12 and/or 14 through to the FIG. 4, 4A position.

As more of the contents of tube/container 30 are expelled and tube/container 30 is further wound upon spindle 16, device I0 is rotated further from the position shown in FIGS. 4 and 4A to the position shown in FIGS. 5 and 5A and stop members 22 and 26 are moved into contact with the top side 36 of tube/container 30. With the application of sufficient external forces, stop members 22 and 26 are now flexed or deformed upwardly as were stop members 20,24 as shown in FIGS. 3 and 3A. Handles 12 and/or 14 would then be rotated still further until stop members 22, 26 are snapped back to lock against the under side 38 of tube/container 30 as were stop members 20, 24 in FIGS. 4 and 4A. A cycle of continuous winding, flexing and locking is thus provided by repeating the sequential flexible deformation of successive stop members which then snap back underneath tube/container 30 to lock device 10 in that position relative to tube/container 30 as shown and described in the progression through FIGS. 2–5 so that tube/container 30 will be progressively wound onto spindle 16 and will not naturally unwind. Tube/container 30 may then ultimately be fully wound onto device 10 to completion of content extrusion.

In the above-described embodiment, stop members 20, 22, 24 and 26 are simply flexible meaning that they may flex in any direction so long as a sufficient external force is applied to device 10 to cause the rotational movement and flexing of members 20, 22, 24 and 26. Thus, device 10 as described above can be forced to unwind by reversing the direction of rotation and external force application.

Contrarily, one-way flexibility may also be used in alternative embodiments of the present invention. The primary advantage of one-way flexibility is the assurance of no undesirable unwinding due solely to the inherent resiliency in the tube/container as it applies a natural unwinding force against the respective stop members of device 10. Such one-way flexibility may be achieved by any of several possible alternatives. For example, certain materials may inherently provide one-way flexibility for stop members 20, 22, 24 and 26. Otherwise, certain structural modifications may be made to achieve one-way flexibility. For example, as shown in FIG. 6, strategically placed elongated notches will provide a form of one-way flexibility. In particular, notches 40, 42, 44 and 46 are disposed as shown relative to corresponding stop members 20,22,24 and 26. Situated as shown (disposed in the bottom face of device 10), notches 40 and 44 provide for the upward flex of respective stop members 20 and 24. Thus, stop members 20,24 will be able to be flexed upwardly in use in a fashion similar to that for the embodiment shown and described in FIGS. 3 and 3A. Note, as shown in FIG. 6, notches 42 and 46 are disposed on the opposite face of device 10 (the top face shown in FIG. 6). Even though this may at first appear to provide an opposite flexing orientation (for stop members 22,26 relative to stop members 20, 24), this opposing disposition of notches 42,46 nevertheless also provides for the upward flex of corresponding stop members 22 and 26 when they are rotated into place adjacent tube/container 30 in the orientation corresponding to that shown and described in FIGS. 5 and 5A. With notches such as these then the entire device need not necessarily be constructed of an inherently resilient material even though plastics having this characteristic are still preferred. This embodiment emphasizes a flexible connection (provided by the notches) of stop members to the handle portions as opposed to inherently flexible stop members. Thus, device 10 may be made from numerous foreseeable materials, some of which being relatively non-resilient so long as a flexible connection is formed or used. Indeed, depending on the available materials and means for construction, this may be the preferred form of the present invention. For example, it is preferred from a manufacturing standpoint to cut thin kerf as notches 40,42, 44 and 46 using a sharp knife edge. Thus, the "V"-shapes for notches 40–46 shown in FIG. 6 may be considered exaggerated in terms of width.

A further alternative embodiment which provides for another type of one-way flexibility for stop members 20, 22, 24 and 26 is shown in FIG. 7. In this embodiment, device 10 including stop members 20, 22, 24 and 26, is again, preferably made from a resilient, flexible material which allows for flexible movement of stop members 20, 22, 24 and 26 relative to handle portions 12 and 14. However, this embodiment further includes a structural modification of preformed bends in stop members 20, 22, 24 and 26 relative to the handle portions 12 and 14. These bends then provide for requiring less force (and, hence less inherent resilience in the material of device 10 and or stop members 20, 22, 24 and 26) for flexing the relative stop members as they are moved through initial contact with and then to the snapped-back, locking position against the under side 38 of tube/container 30 as shown in FIGS. 2–5. With this embodiment of preformed bends, a minimal resiliency is required of the material of device 10 and the respective stop members; however, it is conceivable that less resiliency would be required with the preformed bends than might be necessary for the unbent stop members of the embodiment of FIG. 1.

Another alternative feature is shown by the device of FIG. 7. In particular, the preformed bends actually shown in FIG. 7 are oriented to provide for an alternative, opposite rotational direction for use of device 10. Using the alternative embodiment of FIG. 7 with a tube/container 30 disposed in the operative orientation of FIGS. 2–5, then the FIG. 7 device would be rotated in the opposite direction (counterclockwise, not shown) such that the respective stop members would be rotated up to first contact the underside 38 of tube/container 30 and then flex downwardly as the handle or handles 12, 14 are simultaneously and continuously rotated upwardly until the respective stop members move past tube/container 30 and then lock against the upper side 36 of tube/container 30. Note, this opposite rotational direction may be incorporated into and used with any of the other embodiments of this invention as well. For example, the inherent two-way flexibility of the first described embodiment may thus allow for ready application to any tube/container 30 in either rotational direction as desired by the user. However, as another example, the notched embodiment of FIG. 6 is predominantly a one-way flexible device thus requiring structural modifications to allow for this reverse rotational application. To do so, the notches would need to be formed in the opposite faces of device 10 relative to those shown in FIG. 6. Similarly, the embodiment of FIG. 7 would also require structural modifications to allow for clockwise rotation; the preformed bends would need to be pre-bent in the opposite direction.

Other alternative embodiments of the present invention abound. For example, as shown in FIG. 8, a device 10 would be functional (if perhaps, less effective) with only two stop members 20 and 22 on one handle portion 12 (or 14, not shown). Similarly, the present invention is still workable with only one stop member 20 as shown in FIG. 9; though more stability could perhaps be developed with at least two stop members 20 and 24 disposed one each on each end of spindle portion 16 as shown for example in FIG. 10. Of course, it is also possible for other similar, unshown alternatives to be found workable as well. Stop members on opposite, alternative sides of spindle 16 could also be used, perhaps stops 20 and 26, without stops 22, 24, for example (not shown).

FIG. 11 shows an embodiment with two further alternative features. First is a handle portion 12 which includes a knurled or pebbled portion 50 for increasing manual grip. Knurled portion 50 may be formed in an enlarged handle and recessed therein (as shown). It may also be formed in other handle sizes (smaller or larger) and/or it may be raised, or it may merely be coplanar with handle 12. A similarly knurled, enlarged or other shaped or sized handle 14 (not shown) may be included as well. The second alternative feature shown in FIG. 11 is a simpler spindle portion 16 not having a slot 18 formed therein. Without the slot, a tube/container 30 would still be wound therearound although it would only be anchored thereto by stop members 20–26 and the friction and/or compressive forces presented by successive windings of tube/container 30. Understanding the operability of this feature, it can easily be seen that the shape of spindle portion 16 may be variable in other ways as well. For example, though generally rectangular cross sections have been shown thus far, circular, ovular and other cross sectional shapes will work as well. Hence, spindle 16 could take on circular, rectangular or numerous other-shaped cylindrical forms with or without slots disposed therein. Either of these alternative FIG. 11 features may be readily adapted to any of the previously or subsequently described embodiments also.

Figure 12:
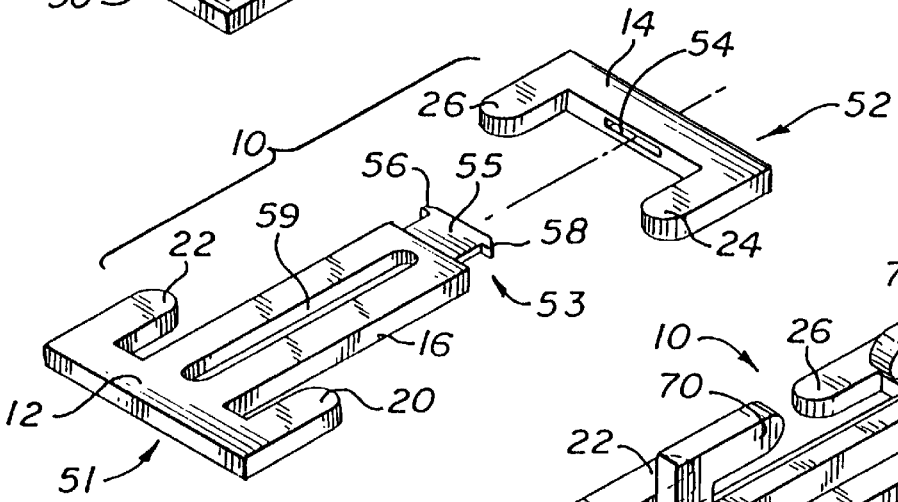
FIG. 12 is an isometric view of another alternative embodiment of the present invention.

FIG. 12 shows another alternative embodiment with two additional variable features. In particular first, device 10 is shown as two separate but connectable component parts. One part, the first component part 51, comprises a handle 12 (with stop members 20 and 22 disposed thereon as described in any of the other embodiments above) and a spindle 16. Spindle 16 has a head end 53 which is to be inserted into a mating aperture or like receptacle 54 disposed in the second component part 52 of this alternative embodiment. Second component part 52 has a handle portion 14 with two stop members 24 and 26 disposed thereon (as described above). Preferably, head end 53 has a necked down portion 55 and at least one deformable lock member such as the shown lock members 56, 58 in FIG. 12. While head end 53 is inserted into an aperture/receptacle 54, lock members 56, 58 are deformed until lock members 56, 58 emerge and are allowed to resiliently return to their natural extended form and thereby lock the connection of the two parts of this embodiment together into one working winding and locking device 10. Necked-down portion 55 provides for disallowing further movement of handle 14 onto spindle 16. A plethora of connection possibilities are available from the art for connecting spindle 16 with handle portion 14 as modifications of this described embodiment involving the necked-down portion 55 and lock members 56, 58 described here.

Moreover, handle portion 12 may alternatively be a separate component part (not shown) either in addition to or instead of a separate handle portion 14. A similar lock member/receptacle connection may be used here also, or any of the other art-filled connection possibilities may be used.

The embodiment of FIG. 12 has a second alternative feature that involves a slit or groove 59 which does not extend completely through spindle 16 as did slot 18. Nevertheless, slit 59 operates in much the same manner by receiving the extreme end 34 of tube/container 30 therein to secure the rear end portion 32 of tube/container 30 during the winding process. Though a slit 59 may not provide the degree of security from withdrawal of tube end 34 there from as is available from a slot 18, it may provide advantages in simplified manufacturing. Further, once one or more windings or coils of tube/container 30 are formed around spindle 16 then these windings will provide additional frictional and/or compressive restraints sufficient to secure the end portion 32 of tube/container 30 in place on spindle 16.

Figure 13:
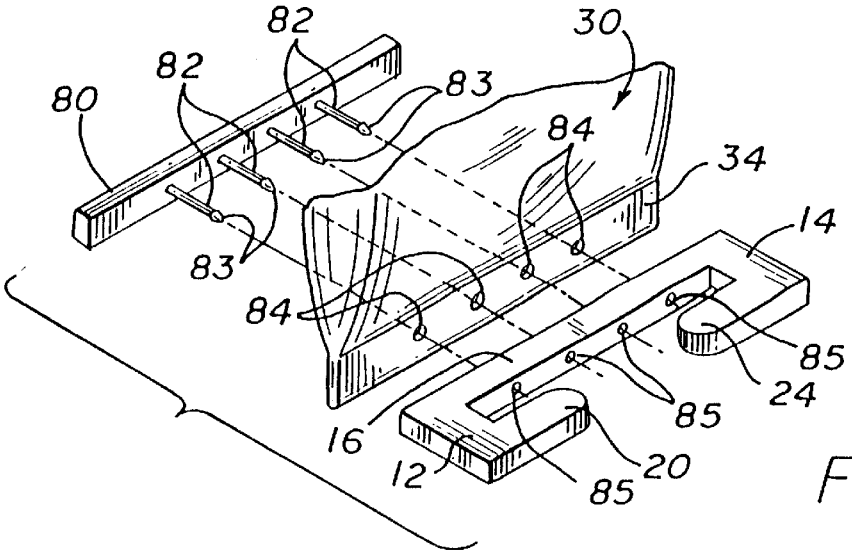
FIG. 13 is an isometric view of yet another alternative embodiment of the present invention.

FIG. 13 also shows an alternative multiple component embodiment. A first component part comprises handle portions 12 and 14 connected to the ends of a spindle portion 16 as before. Handle portion 12 has a stop member 20 attached to handle member 24 is attached to handle portion 14 also as before. However, a second component is included herewith which has an elongated bar portion 80 to which are connected one or more projecting members 82 having conical heads 83. Heads 83 are deformable and are inserted through apertures 84 in a tube/container 30 and apertures 85 in spindle portion 16 of the first component part. Deformable heads 83 resiliently rebound to lock bar 80 to spindle 16 holding tube end 34 therebetween. The tube/container 30 may then be wound and locked on spindle 16 in the fashion described above. This and similar connection structures may be used on any of the other embodiments described herein or equivalents thereof.

Figure 14:
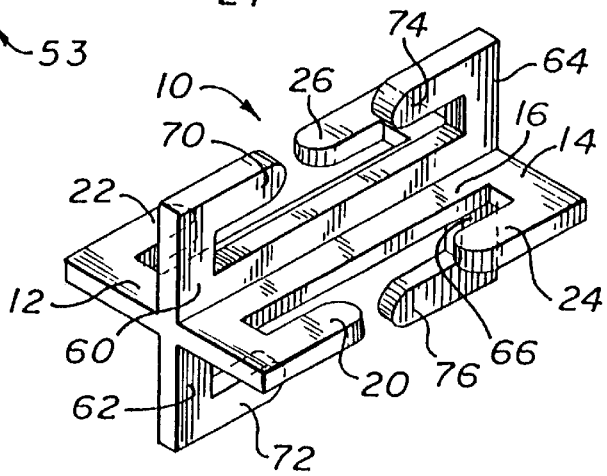
FIG. 14 is an isometric view of still another alternative embodiment of the present invention.

FIG. 14 shows yet another alternative embodiment, this one involving a plurality of further stop members to give greater locking ability. In this embodiment, the effective addition of four further half-handle portions 60 and 62, and 64 and 66 at right angles to handle portions 12, 14 provides for the addition of four further stop members 70, 72, 74 and 76. Thus, with this embodiment, tube/container 30 is locked against unwinding at every quarter-turn instead of every half-turn as is the case with the devices of FIGS. 1, 6–8 and 11–12; or every full-turn as with the embodiments of FIGS. 9 and 10. Such half-handle portions may be added at other angles also. Thus, even more stop members could be provided by this or other alternatives to produce still further locking options at smaller and smaller or other distinct increments as desired.

Note, the shapes and relative dimensions of the various component parts shown in the drawings are not intended to be limiting as to the scope of the invention. Rather, depending on the choice of materials used for the manufacture of a device 10 as well as on the tubes and/or contents thereof to which it may be applied, other component sizes and shapes may prove useful as well. For example, for toothpaste tubes, perhaps smaller, not necessarily rounded stop members 20–26 may be used. Also, rounded, relatively smaller spindles may be useful therefor. However, for stiffer containers and/or contents such as caulking, for example, perhaps larger stop members, et cetera, may be necessary. Further, perhaps metallic materials would prove more desirable in such applications. Also, the stop members may be spaced greater or lesser distances from the spindle depending on the application.

From the foregoing, it is apparent that a novel and unique invention has been herein described and illustrated which fulfills all of the aforestated objectives in a remarkably unexpected fashion. It is, of course understood that such modifications, variations or adaptations as may readily occur to an artisan familiar with the art to which this invention pertains are intended within the spirit of this invention which is limited only by the scope of the claims appended hereto.

Accordingly, what is claimed is:

1. A device for winding and locking containers, said device comprising a spindle about which the container is wound, said spindle having a first end and a second end; handle portions connected to said spindle at each said end thereof; and at least one stop member connected to each said handle portion whereby said stop member provides means for contacting the container and locking a wound portion of the container on the spindle by contact with said container.

2. A device according to claim 1 in which each said handle portion has a first and a second end, said stop members being disposed one each on each of said first and second ends of said handle portion.

3. A device according to claim 1 in which said at least one stop member is flexible such that upon application of a force external of the device and the container, said stop member will flex upon contact with the container.

4. A device according to claim 3 in which said flexibility of said at least one stop member is an inherent characteristic of the material of which said at least one stop member is formed.

5. A device according to claim 1 in which said at least one stop member is flexibly attached to said handle portion whereby upon the application of an external force to the device relative to the container, said stop member will move flexibly relative to said handle portion upon contact of said stop member with the container.

6. A device according to claim 5 in which the flexible attachment of said stop member to said handle portion is an elongated notch formed at the conjunction of said stop member to said handle portion.

7. A device according to claim 1 in which said at least one stop member is flexibly attached to said handle portion whereby upon the application of an external force to the device relative to the container, said stop member will flexibly move relative to said handle portion upon contact of said stop member with the container, said flexible attachment of said at least one stop member being accomplished by a preformed bend of said stop member relative to said handle portion.

8. A device according to claim 1 in which said spindle has an elongated slot formed therein which slot is an aperture disposed through the spindle.

9. A device according to claim 1 in which said spindle, at least one of said handle portions, and at least one of said stop portions are formed as an integral structure.

10. A device according to claim 1 in which said spindle, said first handle portion and said stop member on said first handle portion are formed as a first unitary component part and said second handle portion and said at least one stop member on said second handle portion are formed as a separate second unitary component part which corresponds to and is assembled with said first unitary component part to form a single device for winding and locking containers.

11. A device according to claim 10 in which said spindle has a free end which has a necked-down portion and at least one lock member; and in which said second handle portion has an aperture which corresponds to and into which said free end of said spindle may be inserted to assemble and produce the single device for winding and locking containers.

12. A device according to claim 1 in which said spindle is formed as a first unitary component part and in which said handle portion and said stop member are formed as a separate second unitary component part which corresponds to and is assemblable with said first unitary component part to form a single device for winding and locking containers.

13. A device according to claim 12 in which said spindle has a free end which has a necked-down portion and at least one lock member; and in which said handle portion has an aperture which corresponds to and into which said free end of said spindle may be inserted to assemble and form the single device for winding and locking container.

14. A device according to claim 1 which further comprises at least one half-handle portion attached to said handle portion at a right angle to said handle portion, said half-handle portion having a half-handle stop member attached thereto, whereby said half-handle stop member provides for contacting the container and locking a wound portion of the container on the spindle by contact of said half-handle stop member with said container.

15. A device for winding and locking tubular containers, said device comprising a spindle about which the container is wound, said spindle having first and second ends; first and second handle portions, each one of said handle portions being connected to each of said first and second ends of said spindle; and at least one stop member connected to each of said first and second handle portions, each said stop member being spaced a preselected distance from said spindle, whereby each said stop member provides for contacting the container and locking a wound portion of the container on the spindle by contact with said container.

16. A device according to claim 15, in which said each of said stop members is flexibly connected to each respective handle portion.

17. A device for winding and locking tubular containers comprising a first component having a spindle with first and second ends and at least one aperture defined therethrough, said first component further having a handle portion connected to said first end of said spindle and a stop member connected to said handle portion spaced a preselected distance from said spindle, and a second component having a bar and at least one projection member attached to said bar, each of said at least one projection member being engagable with an aperture formed in the tubular container when coiled and with each said at least one aperture in said spindle of said first component to secure the tubular container to said device for winding and locking the tubular container.

18. A device according to claim 17 in which said first component has a plurality of apertures defined therethrough and said second component has a plurality of projection members defined thereon, each said projection member corresponding to a different one of said apertures and insertable therein to secure said tubular container to said device.

19. A device according to claim 17 which said device is rotated to extrude the contents of said tubular container.

* * * * *